US011512267B2

(12) United States Patent
Moroz et al.

(10) Patent No.: US 11,512,267 B2
(45) Date of Patent: Nov. 29, 2022

(54) ACTIVE SUBSTANCE WAFER

(71) Applicant: SYMRISE AG, Holzminden (DE)

(72) Inventors: Maryna Moroz, Munich (DE); Ranjita Shegokar, Goch (DE); Jörn Wiedemann, Holzminden (DE)

(73) Assignee: SYMRISE AG, Holzminden (DE)

( * ) Notice: Subject to any disclaimer, the term of this patent is extended or adjusted under 35 U.S.C. 154(b) by 208 days.

(21) Appl. No.: 16/649,182

(22) PCT Filed: Sep. 22, 2017

(86) PCT No.: PCT/EP2017/074048
§ 371 (c)(1),
(2) Date: Mar. 20, 2020

(87) PCT Pub. No.: WO2019/057294
PCT Pub. Date: Mar. 28, 2019

(65) Prior Publication Data

US 2020/0216782 A1 Jul. 9, 2020

(51) Int. Cl.

| | |
|---|---|
| ***C11D 1/00*** | (2006.01) |
| ***C11D 3/37*** | (2006.01) |
| ***C11D 3/50*** | (2006.01) |
| ***C11D 17/06*** | (2006.01) |
| ***C11D 3/22*** | (2006.01) |
| ***C11D 3/28*** | (2006.01) |
| ***C11D 3/43*** | (2006.01) |
| ***C11D 11/00*** | (2006.01) |
| ***C11D 17/04*** | (2006.01) |

(52) U.S. Cl.
CPC ..... *C11D 3/3753* (2013.01); *C11D 3/222* (2013.01); *C11D 3/28* (2013.01); *C11D 3/43* (2013.01); *C11D 3/50* (2013.01); *C11D 3/505* (2013.01); *C11D 11/0017* (2013.01); *C11D 11/0023* (2013.01); *C11D 17/044* (2013.01)

(58) Field of Classification Search
CPC ..... C11D 1/00; C11D 3/222; C11D 3/3753; C11D 3/50; C11D 3/505; C11D 17/042; C11D 17/06
See application file for complete search history.

(56) References Cited

U.S. PATENT DOCUMENTS

| | | | | |
|---|---|---|---|---|
| 4,209,417 A * | 6/1980 | Whyte | ..... | C11D 3/505 424/76.4 |
| 10,517,802 B2 * | 12/2019 | Siegel | ..... | C11D 3/225 |
| 2004/0048759 A1 * | 3/2004 | Ribble | ..... | C11D 17/00 510/141 |

FOREIGN PATENT DOCUMENTS

| | | | | |
|---|---|---|---|---|
| CN | 101755040 A | 6/2010 | | |
| EP | 0728804 A1 | 8/1996 | | |
| EP | 1479735 A1 | 11/2004 | | |
| WO | 2009047124 A1 | 4/2009 | | |
| WO | WO 2016/134977 * | 9/2016 | ..... | A61Q 13/00 |

OTHER PUBLICATIONS

Chinese Office Action dated Jan. 19, 2021, for corresponding Chinese Application No. 201780095141.8.
International Search Report and Written Opinion dated May 24, 2018 for corresponding PCT Application No. PCT/EP2017/074048.

* cited by examiner

*Primary Examiner* — Brian P Mruk
(74) *Attorney, Agent, or Firm* — Polsinelli PC

(57) ABSTRACT

The present invention relates to an active substance wafer and methods for producing such an active substance wafer. Further, the present invention relates to the use of such an active substance wafer as/in a laundry care agent, a hand laundry washing agent or a dishwashing agent and to a product selected from these agents consisting or comprising an active substance wafer.

20 Claims, No Drawings

ACTIVE SUBSTANCE WAFER

CROSS-REFERENCE TO RELATED APPLICATIONS

This application is a national stage application (under 35 U.S.C. § 371) of PCT/EP2017/074048, filed Sep. 22, 2017, which is incorporated herein by reference in its entirety.

The present invention relates to an active substance wafer, which can be used as/in a laundry care agent, hand laundry washing agent or dishwashing agent. The active substance wafer hereby provides the release of an active substance, e.g. a fragrance, a cleaning-active and/or protective substance and/or a functional agent when getting in contact to water or another cleaning solution. The present invention further relates a simple method for the production of such an active substance wafer.

Usual scent or fragrance boosters are known in prior art for various applications. EP 1614743 discloses for example fragrance containing, water soluble polysaccharide or cellulose films. Polysaccharide or cellulose films, however, rather show a low solubility or, respectively, do not tend to residue-free solubilisation.

Scent or fragrance boosters can also be produced from molten polyethylene glycol (PEG) or PEG mass, in which the fragrance booster is present. Such a scent of fragrance booster is for instance marketed by Downy Unstopables®. By getting in contact with water, the PEG dissolves and the fragrance is released.

Melting of PEG is usually performed at a temperature of 80 to 200° C. or more. Due to the high temperature, the production method becomes more complicated and cost intensive. The high temperature requires more complex devices and an increased energy consumption. Further, the handling is more complex and requires more time. Moreover, when choosing the further ingredients, especially the fragrances and aromatic substances, their thermostability needs to be considered.

The object of the present invention is to provide an active substance wafer and a method for its production, in which the previously mentioned disadvantages are resolved. A further objective is to provide an active substance wafer with a simple production and using cost effective ingredients, which is also easy to handle and can be used over a broad range of temperature. Even another object of the present invention is to provide an active substance wafer, which can be easily adapted to various consumer requirements, including the design/form, loading with e.g. fragrances etc., and which is also suitable for hand laundry washing.

These objectives are achieved by the active substance wafer according to the invention and the method for its production.

Therefore, an active substance wafer is provided, comprising or consisting of

- 1.0 to 50.0 parts by weight, preferably 2.0 to 20.0 parts by weight, of a (or more, compare below) water-soluble polyvinyl alcohol,
- 1.0 to 60.0 parts by weight, preferably 1.0 to 40.0 parts by weight, particularly preferably 1.0 to 20.0 parts by weight, of an (or more, compare below) active substance,
- (optionally) 0 to 5.0 parts by weight of a (or more, compare below) water-insoluble polymer, and
- (optionally) 0 to 10.0 parts by weight of an (or more, compare below) additive.

If the active substance wafer does not only consist of the previously mentioned components, but also comprises further components, the parts by weight information are preferably understood as "wt.-%" information, related to 100 wt.-% of the active substance wafer.

Additionally, a method for the production of an active substance wafer, preferably an active substance wafer according to the invention, is provided. The method comprises the hereafter listed steps or consists of the hereafter listed steps:

providing a carrier material, addition of a mixture onto the substrate material, drying of the mixture under formation of a layer, and detaching the layer from the substrate material.

wherein the mixture comprises

- 1.0 to 50.0 parts by weight, preferably 2.0 to 20.0 parts by weight, parts by weight of a (or more, compare below) water-soluble polyvinyl alcohol,
- 1.0 to 60.0 parts by weight, preferably 1.0 to 40.0 parts by weight, particularly preferably 1.0 to 20.0 parts by weight, parts by weight of an (or more, compare below) active substance,
- 0 to 5.0 parts by weight of a (or more, compare below) water-insoluble polymer, and
- 0 to 10.0 parts by weight of an (or more, compare below) additive.

Hereby and within the remaining text applies according to a preferred embodiment for the parts by weight information, that the parts by weight information is preferably understood as "wt.-%" information.

The obtained and detached layer can be cut or split into a desired form. The obtained and detached layer or the cut or split layer finally represents the active substance wafer according to the invention.

The term "wafer" as used herein relates to the physical design of the active substance wafer. With the method according to the invention, flat films or layers are obtained, which can be cut or split into a desired form. A "wafer" thus preferably means a planar structure in any desired form, preferably is in e.g. round, triangular, rectangular, spiral, square, pentagonal or hexagonal form. It is obvious that rectangular or square forms have the advantage that the complete film can be used and no reject, i.e. an undesired form, is obtained.

In a preferred embodiment of the invention, several detached layers and/or several cut or split layers can be combined (e.g. pressed together) to form the active substance wafer, wherein the composition of the mixtures according to the invention, which are used in the production of the respective layers, may be the same, may be the same in some of the respective mixtures or may differ from each other.

The wafer can therefore further exist in various forms, e.g. multilayered or compressed (e.g. as a tablet) and can further have different layers with the same or with different water-soluble polyvinyl alcohols and/or active substances and/or water-insoluble polymers and/or additives.

The form can further readily be adapted to the requirements of the respective chosen market. As long as e.g. the wafer is a wafer planned to be used for hand washing and the aimed marked is young people or children, the form of the wafer can e.g. be designed in the shape of a cartoon character, etc. It is also possible to colour the wafer with one or more dyes for an appealing design.

The colour and/or the form of the wafer can also be intended for a signal effect. Therefore, wafer with different ingredients can be coloured/shaped differently, so that a consumer readily recognizes the respective intended use or the respective ingredients. For instance, vivid colours, e.g. a vivid yellow or red, as warning colour can be understood as potentially harmful ingredients, with which skin contact is to be avoided.

In one embodiment of the method according to the invention, the mixture comprises a solvent, in which the water-soluble polyvinyl alcohol is dissolved.

In a further embodiment of the method according to the invention, the solvent is applied at a temperature of 20° C. to 75° C., preferably 20° C. to 50° C., more preferably 20 to 25° C.

In an even further embodiment of the method according to the invention, the substrate material is selected from the group consisting of metal, plastic and glass, wherein preferably the metal, plastic or glass is coated, wherein more preferably the metal, plastic or glass is coated with melanin.

In an embodiment of the invention, the active substance wafer is obtainable or obtained by a method according to the invention.

Furthermore, a mixture according to the invention for the production of an active substance wafer, preferably of an active substance wafer according to the invention, is provided. The mixture according to the invention comprises or consists of

- 1.0 to 50.0 parts by weight, preferably 2.0 to 20.0 parts by weight, parts by weight of a (or more, compare below) water-soluble polyvinyl alcohol,
- 1.0 to 60.0 parts by weight, preferably 1.0 to 40.0 parts by weight, particularly preferably 1.0 to 20.0 parts by weight, parts by weight of an (or more, compare below) active substance,
- (optionally) 0 to 5.0 parts by weight of a (or more, compare below) water-insoluble polymer, and
- (optionally) 0 to 10.0 parts by weight of an (or more, compare below) additive and
- 45.0 to 97.0 parts by weight of a (or more, compare below) solvent.

The solvent can be removed completely or almost completely by drying for obtaining the active substance wafer according to the invention. It is obvious that traces of the solvent can be present in the active substance wafer, potentially also after a drying step. Therefore, 1 wt.-% (or parts by weight) or less, as for example 0.5 wt.-% (or parts by weight), 0.1 wt.-% (or parts by weight), 0.05 wt.-% (or parts by weight), 0.01 wt.-% (or parts by weight) or 0.001 or less of the solvent can be present in the active substance wafer. Preferably, the amount of solvent is 0 wt.-%.

The method according to the invention is easily performed and requires minimal effort regarding the used devices, the energy demand as well as the know-how of the correct performance of the procedure. The obtained active substance wafer can be produced in various forms and with various colours or combinations of forms and colours, by which a recognition by the consumer and where applicable signal effect with regard to the used ingredients can be achieved. Additionally, the composition of the active substance can readily be varied for that different markets with different consumer requirements can readily be satisfied.

It was further found that the use of one or more polyvinyl alcohols enables a time of dissolution in a range of e.g. 1 hour or less, as for example 30 min, 20 min, or 10 min, or less, wherein simultaneously the dimensions and/or the volume of the wafer can be varied over a broad range. The active substance wafer according to the invention can therefore be provided in form of globules/beads with a diameter of 0.5 cm or less, as for example 0.25 cm, or 0.1 cm or less. Alternatively and preferably, an active substance wafer is provided, which has a volume of 1 $cm^3$ or more, as for example 2 $cm^3$, 3 $cm^3$, 4 $cm^3$, 5 $cm^3$ or 10 $cm^3$ or more. The active substance wafer can hereby be produced in any desired spatial form. The possibility to produce active substance wafers with a big volume provides more extensive choices regarding the design of the wafer and advantages in their handling.

Furthermore, the use of the active substance wafer according to the invention as/in a laundry care agent, hand laundry washing agent or dishwashing agent is provided.

Preferably, in the active substance wafer according to the invention, methods for its production and mixtures one or more polyethylene glycols (PEGs) is/are not used. The use of PEGs can thus, especially as main component, result in higher production costs and undesired restrictions regarding the selected ingredients. As further preferred, are no further water-insoluble polymers (including PEG) are used. Thereby, the used polyvinyl alcohol is the only water-soluble polymer in the active substance wafer, methods for its production and mixture, all according to the invention.

In one embodiment of the present invention, a product selected from the group consisting of a laundry care agent, a hand laundry washing agent and a dishwashing agent, consists of or comprises an active substance wafer according to the invention.

The term "hand laundry washing" is to be understood as manual laundry washing or laundry washing by hand. Therefore, a "hand laundry washing agent" is to be understood as an agent used in such manual laundry washing or laundry washing by hand, such as a hand detergent.

If the active substance wafer according to the invention is used as/in a dishwashing agent or is intended to be used in or on or with materials to be ingested, or materials intended to be in contact with materials to be ingested, the active substance wafer comprises or consists of food grade substances.

The term "a water-soluble polyvinyl alcohol" as used herein, relates to a polyvinyl alcohol (PVHO), which completely dissolves in 80 to 97 wt.-%, preferably 80 to 90 wt.-% of water in the used amount, consequently in 2.0 to 20.0 wt.-%, at a temperature of 20° C. to 80° C., preferably 20° C. to 60° C., as well as 20° C. to 50° C., 20° C. to 40° C., 20° C. to 30° C. or 20° C. to 25° C., preferably at room temperature (22° C. to 24° C.) at normal pressure (0.9 to 1.1 bar). In other words, meeting the mentioned criteria, only a single phase is obtained. It is thereby ensured, that the active substance wafer completely/residue-freely dissolves in water when used.

Preferably, the used water-soluble polyvinyl alcohol is also completely soluble in form of the mixture according to the invention. Consequently, 1.0 to 50.0 wt.-%, preferably 2.0 to 20.0 wt.-% of the water-soluble polyvinyl alcohol dissolve in 45.0 to 97.0 wt.-% of a solvent, preferably 80 to 90 wt.-% of a solvent, in such a way that a single phase is obtained. By the fact that the solubility of the polyvinyl alcohol in water as well as in the used solvent, e.g. an ethanol-water-mixture, is ensured, the production of an active substance wafer with a homogeneous composition is favoured. This active substance wafer further dissolves completely/residue-freely in water when used.

The molecular weight of the used water-soluble polyvinyl alcohol should be selected in a way that when the solvent is removed, a solid film or a solid material arises. Consequently, the water-soluble polyvinyl alcohol should be already present as polymer. Suitable polyvinyl alcohols and their production are known to the person skilled in the art.

The water-soluble polyvinyl alcohol can have different chemical modifications, preferably at several of the hydroxyl groups. The accomplishment of such chemical modifications is known to the person skilled in the art.

As suitable chemical modifications, anionic as well as cationic modifications can be used. These and their introduction into the water-soluble polyvinyl alcohol while obtaining a desired degree of saponification are known to the person skilled in the art. Examples of anionic groups, which are introduced into a polyvinyl alcohol for modification, comprise carboxyl groups, sulphonic acid groups, phosphoric acid groups, etc. The use of carboxyl groups influences the solubility of the polyvinyl alcohol in such a way that higher temperatures, e.g. 40° C. or more, and longer times for solubilisation are required. Therefore, polyvinyl alcohols modified at their carboxyl groups are particularly well suited for agents in laundry care or dishwashing.

Examples for unsaturated monomers for carboxyl group modifications comprise for example ethylenically unsaturated dicarboxylic acids such as maleic acid, fumaric acid or itaconic acid, an ethylenically unsaturated dicarboxylic acid monoester as a monoalkyl maleate, a monoalkyl fumarate or a monoalkyl itaconeate, an ethylenically unsaturated dicarboxylic acid diester as dialkyl maleate, dialkyl fumarate or a dialkyl itaconate, with the proviso that these diesters are converted to carboxyl groups by hydrolysis, when the obtained copolymers are hydrolysed, an ethylenically unsaturated dicarboxylic acid anhydrite as maleic acid anhydrite or itaconic acid anhydrite, an ethylenically unsaturated monocarboxylic acid as (meth)acrylic acid or crotonic acid, and salts of these compounds as for example alkali metal salts, particularly potassium salt or sodium salt.

According to a preferred embodiment, the water-soluble polyvinyl alcohol has an average degree of hydrolysis of 65 to 99.99 Mol %, preferably 75 to 95 Mol %, particularly preferably 85 to 90 Mol %.

In the scope of the present invention, the terms degree of hydrolysis, degree of saponification and polyvinyl alcohol content are synonyms and describe the Mol %-portion of vinyl alcohol units in relation to the portion of vinylacetate groups in the polyvinyl alcohol. The degree of hydrolysis is preferably determined with the vinyl acetate content. The vinyl acetate content is understood as the weight percent portion of acetyl groups, which results from the consumption of the amount of potash required for the saponification of 1g of substance. The method of determination is performed following EN ISO 3681: Approximately 2 g of the substance to be examined are weighed in a 500 ml round bottomed flask with an accuracy of 1 mg and dissolved at the backflow with 90 ml ethanol and 10 ml benzyl alcohol. After cooling, the solution is neutralized with 0.01 NaOH against phenolphtalein. Subsequently, 25.0 ml of 0.1 n KOH are added and it is heated at the backflow for 1.5 hours. The flask is cooled while being closed and the excess of lye is titrated back with 0.1 n hydrochloric acid against phenolphthalein as indicator until the permanent discolouration. Likewise, a blank test is performed. The PV-acetate content is calculated as follows: PV-acetate content [%]=(b−a)*86/E, with a=consumption of 0.1 n KOH for the sample in ml, b=consumption of 0.1 n KOH for blank test in ml and E=weight of sample to be examined taken drying.

The vinyl alcohol group content (polyvinyl alcohol content) is determined by the recalculation of the vinyl acetate content to 100%, which was determined in a).

The used water-soluble polyvinyl alcohols preferably have a viscosity of $3*10^{-3}$ (N s $m^{-2}$) to $7.2*10^{-2}$ (N s $m^{-2}$). Particularly preferred is a viscosity of $1*10^{-2}$ (N s $m^{-2}$) to $6*10^{-2}$ (N s $m^{-2}$), $1.5*10^{-2}$ (N s $m^{-2}$) to $5*10^{-2}$ (N s $m^{-2}$), $2*10^{-2}$ (N s $m^{-2}$) to $4.5*10^{-2}$ (N s $m^{-2}$), $3*10^{-2}$ (N s $m^{-2}$) to $4*10^{-2}$ (N s $m^{-2}$), $3.2*10^{-2}$ (N s $m^{-2}$) to $3.8*10^{-2}$ (N s $m^{-2}$), particularly preferably $3.4*10^{-2}$ (N s $m^{-2}$) to $3.6*10^{-2}$ (N s $m^{-2}$).

The viscosity of the used water-soluble polyvinyl alcohols is preferably determined according to DIN 53015 on a 4% solution in water at 20° C. in the Hoeppler viscosimeter.

The term "active substance" as used herein describes a substance with a desired effect. Exemplary active substances include fragrances, cleaning-active and/or protective substances or functional agents. It is obvious that several active substances of the same kind but also different active substances can be combined. For example, two or more, such as three, four, five, six, seven, eight, nine, ten or more active substances can be used.

Therefore, e.g. two or more, such as three, four, five, six, seven, eight, nine, ten or more fragrances can be used. Therefore, e.g. two or more, such as three, four, five, six, seven, eight, nine, ten or more cleaning-active and/or protective substances can be used. Therefore, e.g. two or more, such as three, four, five, six, seven, eight, nine, ten or more functional agents can be used.

Preferred combinations of different active substances in a single active substance wafer comprise a fragrance and a cleaning-active and/or protective substance, a fragrance and two cleaning-active and/or protective substances, a fragrance and three cleaning-active and/or protective substances, two fragrances and a cleaning-active and/or protective substance, two fragrances and two cleaning-active and/or protective substances, two fragrances and three cleaning-active substances, three fragrances and a cleaning-active and/or protective substance, three fragrances and two cleaning-active and/or protective substances, as well as three fragrances and three cleaning-active substances.

The term "water-insoluble polymer" includes polymers that only partially dissolve or do not dissolve under the respective conditions, under which a water-soluble polymer is solubilised completely. The water-insoluble polymer does not dissolve or only partially dissolves in the used amount, hence 5 wt.-% in 80 to 97 wt.-%, preferably 80 to 90 wt.-% of water at a temperature of 20° C. to 80° C., preferably 20° C. to 60° C., as well as 20° C. to 50° C., 20° C. to 40° C., 20° C. to 30° C. or 20° C. to 25° C., preferably at room temperature (22° C. to 24° C.) at normal pressure (0.9 to 1.1 bar). Thus, a further phase can occur.

The water-insoluble polymers are generally used to provide a desired texture, strength, stiffness, etc. to the active substance wafer. For example, low amounts of cellulose or starches or other polymers as up to 5 wt.-% (or parts by weight) can be used.

Exemplary water-insoluble polymers comprise certain polysaccharides and starches. Starches include for example wheat starch, rice starch, potato starches and numerous chemically modified starches as for example oxidised starches or reduced starches.

The term "additive" includes substances that provide a certain texture and/or other properties to the active substance wafer. Exemplary additives include fillers, disintegrants, binding agents, absorbents, antimicrobials and dyes. For example, two or more, such as three, four, five, six, seven, eight, nine, ten or more additives can be used. These additives can be of the same or different type.

Therefore, two or more, such as three, four, five, six, seven, eight, nine, ten or more additives can be used. Therefore, two or more, such as three, four, five, six, seven, eight, nine, ten or more disintegrants can be used. Therefore, two or more, such as three, four, five, six, seven, eight, nine, ten or more binding agents can be used. Therefore, two or more, such as three, four, five, six, seven, eight, nine, ten or more absorbents can be used. Therefore, two or more, such as three, four, five, six, seven, eight, nine, ten or more antimicrobials can be used. Therefore, two or more, such as three, four, five, six, seven, eight, nine, ten or more dyes can be used.

The term "solvent" as used herein describes polar solvents, particularly preferred organic, polar solvents. A polar solvent describes solvents with a higher dipole moment than n-hexanol. Preferred solvents include water, n-propanol, i-propanol, ethanol and/or methanol; particularly preferably a combination of ethanol and water is used. The person skilled in the art is aware that two or more, such as three, four, five, six, seven, eight, nine, ten or more solvents can be used.

Each water-soluble polyvinyl alcohol can be used. Additionally, two or more different polyvinyl alcohols can be used, for example three, four, five or more different polyvinyl alcohols. For instance, sevol polyvinyl alcohols can be used. Preferred polyvinyl alcohols are the selvol polyvinyl alcohols 205, 523, 540, 805, 823 and 840. Selvol polyvinyl alcohols 203S, 205S, 523S and 540S can be used equally. Selvol polyvinyl alcohol 523 is particularly preferred.

According to an embodiment of the invention, the active substance is selected from the group consisting of a fragrance, a cleaning-active and/or protecting substance, a functional agent, and a combination thereof. The active substance can also be present in encapsulated form, which can be biodegradable or nondegradable or partially biodegradable and partially nondegradable.

Further examples for active substances comprise adsorbents and protecting, particularly skin protecting or skin caring substances.

Fragrances or aromatic substances, that are used in the active substance wafer according to the invention are preferably selected from the group consisting of (customary product and brand names are given): 1-phenyl-2-methyl-2-propylacetate, 2-methylbutylbutyrate, aldron (4-[(3,3-dimethylbicyclo[2.2.1]hept-2-yl)methyl]-2-methylcyclohexanon), allyl-2-cyclohexyloxyglycolate, allyl-2-pentyloxyglycolate, allyl-3-cyclohexylpropionate, allylcapronate, amarocit (1,1-dimethoxy-2,2,5-trimethyl-4-hexene), ambral (dodecahydro-3,8,8,11a-tetra-methyl-5h-3.5a-epoxynaphth[2.1-c]oxepine), ambrettolide (9-hexadecene-16-olide), ambrinol S (1,2,3,4,4a,5,6,7-octahydro-2,6,6-trimethyl-2-napthalinol), ambrinolepoxide, ambrocenide (4ar,5r,7as,9r)-octahydro-2,2,5,8,8,9a-hexamethyl-4h-4a,9-methanoazuleno(5,6-d)-1,3-dioxole), ambroxide (3a,6,6,9a-tetramethyldodecahydronaphtho[2,1-b]-furan), amylformiate, aurelione (7-cyclohexadecene-1-on und 8-cyclohexadecene-1-on), boronal [2-methyl-4-(2,6,6-trimethyl-1-cyclohexene-1-yl)-butenal], brahmanol [2-methyl-4-(2,2,3-trimethyl-3-cyclopentenyl)-butanol], buccoxime (1,5-dimethylbicyclo[3.2.1]octan-8-onoxim), butylacetate, cantryl (2,2,3-trimethyl-3-cyclopentenyl-1-acetonitrile), cassix 150 (4-methoxy-2-methyl-2-butanthiol), chrysantheme [1-(2,4-dimethyl-3-cyclohexene-1-yl)-2,2-dimethyl-1-propanone], cis-3-hexenylacetate, citronellylbutyrate, citronellyltiglinate (3,7-dimethyl-6-octenyl-2-methylcrotonate), citronitrile (3-methyl-5-phenyl-2-pentennitrile), citrowanil b (alpha-ethenyl-alpha-methyl benzeneproprannitrile), claritone (2,4,7-tetramethyl-6-octene-3-on), corps racine vs [2-(3-phenylpropyl)pyridinr], coumarone (1-(2-benzofuranyl)-ethanon), cyclogalbanate (allylcyclohexyloxyacetate), cyclohexylmagnol (alpha-methylcyclohexanpropanol), datilate (1-cyclohexylethylcrotonate), ethyl-2-methylbutyrate, ethylisobutyrate, ethylisovalerate, ethyltricyclo[5.2.1,02,6]decan-2-ylcarboxylate, farenal (2,6,10-trimethyl-9-undecenal), filbertone (5-methyl-2-heptene-4-on), fleursandol (4-(3a,4,5,6,7,7a-hexahydro-4,7-methano-1h-inden-6-yl)-3-methyl-3-butene-2-ol), florazon (4-ethyl-alpha,alpha-dimethyl benzenepropanal), floropal (2,4,6-trimethyl-4-phenyl-1,3-dioxane), fragolane [(2,4-dimethyl-[1,3]dioxolane-2-yl)acetic acid ethylester)], frutinat (but-2-en acid-1,3-dimethylbutyl ester), gamma-decalactone, geranylacetate, geranylbutyrate, geranyltiglinate (trans-3,7-dimethyl-2,6-octadienyl-2-methylcrotonate), globalide [(11/12)-pentadecen-15-olide], globanone (8-cyclohexadecene-1-on), hexylbutyrate, hydrocitronitrite (beta-methyl-benzenepentannitrile), indianol (4-[3a,4,5,6,7,7a-hexahydro-4,7-methano-1h-inden-5(6)-yl]-3-methyl-3-butene-2-ol), indoflor (4,4a,5,9b-tetrahydoindeno[1,2-d]-m-dioxin), irisnitrile (2-nonenylnitrile), isoamylacetate, isoamylisovalerianate, isodamascon [1-(2,4,4-trimethyl-2-cyclohexene-1-yl)-2-butene-1-on], isomuscon (cyclohexadecanon), jacinthaflor (2-methyl-4-phenyl-1,3-dioxolan), ketamber (dodecahydro-3,8,8,11a-tetramethyl-5h-3,5a-epoxynaphth[2.1-c]oxepine), lactojasmon (4-hexyl-4-methylbutyrolactone), leguminal (propanal-methyl-cis-3-hexenyl-acetal), macrolide (oxacyclohexadecan-2-on), madranol (mixture of different hexahydro methylionone), magnolan (2,4-dimethyl-5,6-indeno-1,3-dioxan), majantol [2,2-dimethyl-3-(3-methylphenyl)-propanol], mandaril (3,12-tridecadiennitrile), menthylacetate, methylbutyrate, methyldihydrojasmonate, methylisobutyrate, mintonat (3,3,5-trimethylcyclohexylacetate), mugetanol [1-(4-isopropylcyclohexyl)-ethanol], nerolione [1-(3-methyl-2-benzofuranyl)-ethanon], octylacetate, ozonile (2-tridecennitrile), palisandal (1,1-dimethoxycyclododecan), palisandin (cyclododecylmethyl ether), parmanyl [3-(cis-3-hexenyloxy)-propannitrile], passifloran (3-acetylthiohexylacetate), peacholide (cis- and trans-3-methyl-gamma-decalacton), prenylsalicylat, profarnesal (2,6,10-trimethyl-5,9-undecadienal), projasmon p (2-heptylcyclopentanon), pyroprunate (but-2-en acid bicyclopenten-2-yl-ester), rholiate (carbonic acid-ethyl-2,3,6-trimethylcyclohexylester), rosaphen (2-methyl-5-phenylpentan-1-ol), rosenoxid, sandel 80 (trans-3-isocamphylcyclohexanol), sandranol (2-ethyl-4-(2,2,3-trimethyl-3-cyclopentene-1-yl)-2-buten-1-ol), symrose (4-isoamylcyclohexanol), symroxane (4-(3-methylbutyl)-cyclohexanol (z)), tabanon [4-(2-butenyliden)-3,4,5-trimethyl-2-cyclohexene-1-on], terpineol-4, timberol (2,2,6-trimethyl-alpha-propyl-cyclohexanpropanol), tolylacetataldeyde d para (4-methyl-benzeneacetaldehyde), tricyclodecenylpropionate, tropicol (2-mercapto-2-methylpentan-1-ol), vertosine [2-(2,4-(or 3,5)-dimethyl-3-cyclohexene-1-yl)-methylenaminobenzoic acidmethylester], vertral (octahydro-4,7-methano-1h-indencarbaldehyde), vetikolacetate (1,3-dimethyl-3-phenylbutylacetate), vetival (4-cyclohexyl-4-methylpentan-2-on), ysamber k (spiro hexahydro-1',1',5',5'-tetramethyl-[1,3-dioxolan-2,8'-(5'h)-[2h-2, 4a]-methanonaphthalene].

Further preferred aromatic substances are listed in S. Arctander, Perfume and Flavor Materials, Vol. I and II, Montclair, N. J. 1969, self-publishing, or K. Bauer et al., Common Fragrance and Flavor Materials, 5th Edition, Wiley-VCH, Weinheim 2006.

Alternatively or additionally, extracts of natural raw materials can be used, e.g. essential oils, concretes, absolues, resine, resinoides, balms, tinctures, such as e.g. ambratincture; amyris oil; angelicaseed oil; angelicaroot oil; anise oil; valerian oil; basil oil; tree mossabsolue; bay oil; mugwort oil; benzoic resin; bergamot oil; beeswax-absolue; birch tar oil; bitter almond oil; savoury oil; bucco leaf oil; cabreuva oil; cade oil; calmus oil; campher oil; cananga oil; cardamomen oil; cascarilla oil; cassia oil; cassie-absolue; castoreum-absolue; cedar leaf oil; cedar wood oil; cistus oil; citronella oil; lemon oil; copaivabalm; copaivabalm oil; coriander oil; costus root oil; cumin oil; cypressoil; davana oil; dill herb oil; dill seed oil; eau de brouts-absolue; oakmoss-absolue; elemi oil; estragon oil; eucalyptus-citriodora-oil; eucalyptus oil; fennel oil; spruce needle oil; galbanum oil; galbanumresin; geranium oil; grapefruit oil; guajak wood oil; gurjunbalm; gurjunbalm oil; helichrysum-absolue; helichrysum oil; ginger oil; iris root-absolue; iris root oil; jasmin-absolue; kalmus oil; chamomile oil blue; chamomile oil roman; carrot seed oil; kaskarilla oil; pine needle oil; spearmint oil; caraway oil; labdanum oil; labdanum-absolue; labdanumresin; lavandin-absolue; lavandin oil; lavender-absolue; lavender oil; lemongras oil; lovage oil; lime oil destilled; limette oil pressed; linaloe oil; litsea-cubeba-oil; bay leaf oil; macis oil; majoram oil; mandarin oil; massoirinden oil; mimosa-absolue; musk grain oil; musk tincture; muscatel-sage oil; nutmeg oil; myrrh-absolue; myrrh oil; myrtlen oil; carnation leaf oil; carnation blossom oil; neroli oil; olibanum-absolue; olibanum oil; opopanax oil; orange blossom-absolue; orange oil; origanum oil; palmarosa oil; patchouli oil; perilla oil; perubalm oil; parsley leaf oil; parsley seed oil; petitgrain oil; pepermint oil; pepper oil; piment oil; pine oil; poley oil; rose-absolue; rosewood oil; rose oil; rosemary oil; sage oil dalmatian; sage oil spanish; sandalwood oil; celery seed oil; spike lavender oil; star anise oil; styrax oil; marigold oil; fir needle oil; tea tree oil; turpentine oil; thyme oil; tolubalm; tonka-absolue; tuberose absolue; vanilla extract; violet leaf absolue; verbena oil; vetiver oil; juniper oil; wine yeast oil; vermouth oil; wintergreen oil; ylang oil; ysop oil; zibet-absolue; cinnamon leaf oil; cinnamon bark oil as well as fractions thereof or ingredients isolated thereof.

Single aromatic substances selected from the group of carbohydrates can also be used. Particularly preferred single aromatic substances to be used and of the group of carbohydrates are e.g. 3-carene; alpha-pinene; beta-pinene; alpha-terpinene; gamma-terpinene; p-cymol; bisabolene; camphene; caryophyllene; cedrene; farnesene; limonene; longifolene; myrcene; ocimene; valencene; (e,z)-1,3,5-undecatriene; styrole; diphenylmethan; aliphatic alcohols such as e.g. hexanol; octanol; 3-octanol; 2,6-dimethylheptanol; 2-methyl-2-heptanol; 2-methyl-2-octanol; (e)-2-hexenol; (e)- und (z)-3-hexenol; 1-octen-3-ol; mixture of 3,4,5,6,6-pentamethyl-3/4-hepten-2-ol und 3,5,6,6-tetramethyl-4-methyleneheptan-2-ol; (e,z)-2,6-nonadienol; 3,7-dimethyl-7-methoxyoctan-2-ol; 9-decenol; 10-undecenol; 4-methyl-3-decen-5-ol; aliphatic aldehydes and their acetates as e.g. hexanal; heptanal; octanal; nonanal; decanal; undecanal; dodecanal; tridecanal; 2-methyloctanal; 2-methylnonanal; (e)-2-hexenal; (z)-4-heptenal; 2;6-dimethyl-5-heptenal; 10-undecenal; (e)-4-decenal; 2-dodecenal; 2,6,10-trimethyl-9-undecenal; 2,6,10-trimethyl-5,9-undecadienal; heptanaldiethylacetal; 1,1-dimethoxy-2,2,5-trimethyl-4-hexene; citronellyloxyacetaldehyde; 1-(1-methoxy-propoxy)-(e/z)-3-hexene; aliphatic ketones and their oximes such as e.g. 2-heptanon; 2-octanon; 3-octanon; 2-nonanon; 5-methyl-3-heptanon; 5-methyl-3-heptanonoxime; 2,4,4,7-tetramethyl-6-octene-3-on; 6-methyl-5-heptene-2-on; aliphatic sulphurous compounds such as e.g. 3-methylthio-hexanol; 3-methylthiohexylacetate; 3-mercaptohexanol; 3-mercaptohexylacetate; 3-mercaptohexylbutyrate; 3-acetylthiohexylacetate; 1-menthen-8-thiol; aliphatic nitriles such as e.g. 2-nonene acid nitrile; 2-undecene acid nitrile; 2-tridecene acid nitrile; 3,12-tridecadiene acid nitrile; 3,7-dimethyl-2,6-octadiene acid nitrile; 3,7-dimethyl-6-octene acid nitrile; esters of aliphatic carboxylic acids such as e.g. (e)- und (z)-3-hexenylformiate; ethylacetoacetate; isoamylacetate; hexylacetate; 3,5,5-trimethyl hexylacetate; 3-methyl-2-butenylacetate; (e)-2-hexenylacetate; (e)- and (z)-3-hexenylacetate; octylacetate; 3-octylacetate; 1-octen-3-ylacetate; ethylbutyrate; butyl butyrate; isoamylbutyrate; hexylbutyrate; (e)- and (z)-3-hexenyl-isobutyrate; hexylcrotonate; ethylisovalerianate; ethyl-2-methylpentanoate; ethylhexanoate; allylhexanoate; ethyl heptanoate; allyl heptanoate; ethyloctanoate; ethyl-(e,z)-2,4-decadienoate; methyl-2-octinate; methyl-2-noninate; allyl-2-isoamyloxyacetate; methyl-3,7-dimethyl-2,6-octadienoate; 4-methyl-2-pentylcrotonate; acyclic terpene alcohols such as e.g. citronellol; geraniol; nerol; linalool; lavadulol; nerolidol; farnesol; tetrahydrolinalool; tetrahydrogeraniol; 2,6-dimethyl-7-octene-2-01; 2,6-dimethyloctane-2-ol; 2-methyl-6-methylene-7-octene-2-ol; 2,6-dimethyl-5,7-octadiene-2-ol; 2,6-dimethyl-3,5-octadiene-2-ol; 3,7-dimethyl-4,6-octadiene-3-ol; 3,7-dimethyl-1,5,7-octatriene-3-ol 2,6-dimethyl-2,5,7-octatriene-1-ol; as well as their formiates, acetates, propionates, isobutyrates, butyrates, isovalerianates, pentanoates, hexanoates, crotonates, tiglinates and 3-methyl-2-butenoates; acyclic terpene aldehydes and ketones such as e.g. geranial; neral; citronellal; 7-hydroxy-3,7-dimethyloctanal; 7-methoxy-3,7-dimethyloctanal; 2,6,10-trimethyl-9-undecenal; geranylaceton; as well as the dimethyl and diethylacetals of geranial, neral, 7-hydroxy-3,7-dimethyloctanal; cyclic terpene alcohols such as e.g. menthol; isopulegol; alpha-terpineol; terpinenol-4; menthan-8-ol; menthan-1-ol; menthan-7-ol; borneol; isoborneol; linalooloxid; nopol; cedrol; ambrinol; vetiverol; guajol; as well as their formiates, acetates, propionates, isobutyrates, butyrates, isovalerianates, pentanoates, hexanoates, crotonates, tiglinates and 3-methyl-2-butenoates; cyclic terpene aldehydes and ketones such as e.g. menthone; isomenthone; 8-mercaptomenthan-3-one; carvone; campher; fenchone; alpha-ionone; beta-ionone; alpha-n-methylionone; beta-n-methylionone; alpha-isomethylionone; beta-isomethylionone; alpha-irone; alpha-damascone; beta-damascone; beta-damascenone; delta-damascone; gamma-damascone; 1-(2,4,4-trimethyl-2-cyclohexene-1-yl)-2-buten-1-one; 1,3,4,6,7,8a-hexahydro-1,1,5,5-tetramethyl-2h-2,4a-methanonaphthalene-8(5h)-one; 2-methyl-4-(2,6,6-trimethyl-1-cyclohexene-1-yl)-2-butenal;

nootkatone; dihydronootkatone; 4,6,8-megastigmatrien-3-one; alpha-sinensal; beta-sinensal; acetylated cedar wood oil (methylcedrylketone); cyclic alcohols such as e.g. 4-tert.-butylcyclohexanol; 3,3,5-trimethylcyclohexanol; 3-isocamphylcyclohexanol; 2,6,9-trimethyl-z2,z5,e9-cyclododecatriene-1-ol; 2-isobutyl-4-methyltetrahydro-2h-pyran-4-ol; cycloaliphatic alcohols such as e.g. alpha,3,3-trimethylcyclohexylmethanol; 1-(4-isopropylcyclohexyl)ethanol; 2-methyl-4-(2,2,3-trimethyl-3-cyclopent-1-yl) butanol; 2-methyl-4-(2,2,3-trimethyl-3-cyclopent-1-yl)-2-butene-1-ol; 2-ethyl-4-(2,2,3-trimethyl-3-cyclopent-1-yl)-2-butene-1-ol; 3-methyl-5-(2,2,3-trimethyl-3-cyclopent-1-yl)-pentan-2-ol; 3-methyl-5-(2,2,3-trimethyl-3-cyclopent-1-yl)-4-pentene-2-ol; 3,3-dimethyl-5-(2,2,3-trimethyl-3-cyclopent-1-yl)-4-pentene-2-ol; 1-(2,2,6-trimethylcyclohexyl)pentan-3-ol; 1-(2,2,6-trimethylcyclohexyl)hexan-3-ol; cyclic and cycloaliphatic ether such as e.g. cineol; cedrylmethyl ether; cyclododecylmethyl ether; 1,1-dimethoxycyclododecan; (ethoxymethoxy)cyclododecan; alpha-cedrenepoxid; 3a,6,6,9a-tetramethyldodecahydronaphtho[2,1-b]furan; 3a-ethyl-6,6,9a-trimethyldodecahydronaphtho[2,1-b]furan; 1,5,9-trimethyl-13-oxabicyclo[10.1,0]trideca-4,8-diene; rose oxide; 2-(2,4-dimethyl-3-cyclohexene-1-yl)-5-methyl-5-(1-methylpropyl)-1,3-dioxane; cyclic and macrocyclic ketones such as e.g. 4-tert.-butylcyclohexanone; 2,2,5-trimethyl-5-pentylcyclopentanone; 2-heptylcyclopentanone; 2-pentylcyclopentanone; 2-hydroxy-3-methyl-2-cyclopentene-1-one; 3-methyl-cis-2-pentene-1-yl-2-cyclopentene-1-one; 3-methyl-2-pentyl-2-cyclopentene-1-one; 3-methyl-4-cyclopentadecenone; 3-methyl-5-cyclopentadecenone; 3-methylcyclopentadecanone; 4-(1-ethoxyvinyl)-3,3,5,5-tetramethylcyclohexanone; 4-tert-pentylcyclohexanone; 5-cyclohexadecene-1-one; 6,7-dihydro-1,1,2,3,3-pentamethyl-4(5h)-indanone; 8-cyclohexadecene-1-one; 9-cycloheptadecene-1-one; cyclopentadecanone; cyclohexadecanone; cycloaliphatic aldehydes such as e.g. 2,4-dimethyl-3-cyclohexencarbaldehyde; 2-methyl-4-(2,2,6-trimethyl-cyclohexene-1-yl)-2-butenal; 4-(4-hydroxy-4-methylpentyl)-3-cyclohexencarbaldehyde; 4-(4-methyl-3-pentene-1-yl)-3-cyclohexencarbaldehyde; cycloaliphatic ketones such as e.g. 1-(3,3-dimethylcyclohexyl)-4-pentene-1-one; 2,2-dimethyl-1-(2,4-dimethyl-3-cyclohexene-1-yl)-1-propanone; 1-(5,5-dimethyl-1-cyclohexene-1-yl)-4-pentene-1-one; 2,3,8,8-tetramethyl-1,2,3,4,5,6,7,8-octahydro-2-naphtalenylmethylketone; methyl-2,6,10-trimethyl-2,5,9-cyclododecatrienylketone; tert.-butyl-(2,4-dimethyl-3-cyclohexen-1-yl)ketone; esters of cyclic alcohols such as e.g. 2-tert-butylcyclohexylacetate; 4-tert-butylcyclohexylacetate; 2-tert pentylcyclohexylacetate; 4-tert-pentylcyclohexylacetate; 3,3,5-trimethylcyclohexylacetate; decahydro-2-naphthylacetate; 2-cyclopentylcyclopentylcrotonate; 3-pentyltetrahydro-2h-pyran-4-ylacetate; decahydro-2,5,5,8a-tetramethyl-2-naphthylacetate; 4,7-methano-3a,4,5,6,7,7a-hexahydro-5, or 6-indenylacetate; 4,7-methano-3a,4,5,6,7,7a-hexahydro-5, or 6-indenylpropionate; 4,7-methano-3a,4,5,6,7,7a-hexahydro-5, or 6-indenylisobutyrate; 4,7-methanooctahydro-5, or 6-indenylacetate; esters of cycloaliphatic alcohols such as e.g. 1-cyclohexylethylcrotonate; esters of cycloaliphatic carboxylic acids such as e.g. allyl-3-cyclohexylpropionate; allylcyclohexyloxyacetate; cis- and trans-methyldihydrojasmonate; cis- and trans-methyljasmonate; methyl-2-hexyl-3-oxocyclopentancarboxylate; ethyl-2-ethyl-6,6-dimethyl-2-cyclohexencarboxylate; ethyl-2,3,6,6-tetramethyl-2-cyclohexencarboxylate; ethyl-2-methyl-1,3-dioxolan-2-acetate; araliphatic alcohols such as benzene alcohol; 1-phenylethylalkohol; 2-phenylethylalkohol; 3-phenylpropanol; 2-phenylpropanol; 2-phenoxyethanol; 2,2-dimethyl-3-phenylpropanol; 2,2-dimethyl-3-(3-methylphenyl)propanol; 1,1-dimethyl-2-phenylethylalkohol; 1,1-dimethyl-3-phenylpropanol; 1-ethyl-1-methyl-3-phenylpropanol; 2-methyl-5-phenylpentanol; 3-methyl-5-phenylpentanol; 3-phenyl-2-propen-1-ol; 4-methoxybenzene alcohol; 1-(4-isopropylphenyl)ethanol; esters of araliphatic alcohols and araliphatic carboxylic acids such as e.g. benzylacetate; benzylpropionate; benzylisobutyrate; benzylisovalerianate; 2-phenylethylacetate; 2-phenylethylpropionate; 2-phenylethylisobutyrate; 2-phenylethylisovalerianate; 1-phenylethylacetate; alpha-trichlormethylbenzylacetate; alpha,alpha-dimethylphenylethylacetate; alpha,alpha-dimethylphenylethylbutyrate; cinnamylacetate; 2-phenoxyethylisobutyrate; 4-methoxybenzylacetate; araliphatic ethers such as e.g. 2-phenylethylmethyl ether; 2-phenylethylisoamyl ether; 2-phenylethyl-1-ethoxyethyl ether, phenylacetaldehyddimethylacetale; phenylacetaldehyddiethylacetale; hydratropaaldehyddimethylacetale; phenylacetaldehydglycerinacetale; 2,4,6-trimethyl-4-phenyl-1,3-dioxan; 4,4a,5,9b-tetrahydroindeno[1,2-d]-m-dioxin; 4,4a,5,9b-tetrahydro-2,4-dimethylindeno[1,2-d]-m-dioxin; aromatic and araliphatic aldehydes such as e.g. benzaldehyde; phenylacetaldehyde; 3-phenylpropanal; hydratropaaldehyde; 4-methylbenzaldehyde; 4-methylphenylacetaldehyde; 3-(4-ethylphenyl)-2,2-dimethylpropanal; 2-methyl-3-(4-isopropylphenyl)propanal; 2-methyl-3-(4-tert.-butylphenyl)propanal; 2-methyl-3-(4-isobutylphenyl)propanal; 3-(4-tert.-butylphenyl)propanal; cinnamic aldehyde; alpha-butylzimtaldehyde; alpha-amylzimtaldehyde; alpha-hexylzimtaldehyde; 3-methyl-5-phenylpentanal; 4-methoxybenzaldehyde; 4-hydroxy-3-methoxybenzaldehyde; 4-hydroxy-3-ethoxybenzaldehyde; 3,4-methylendioxybenzaldehyde; 3,4-dimethoxybenzaldehyde; 2-methyl-3-(4-methoxyphenyl)propanal; 2-methyl-3-(4-methylendioxyphenyl)propanal; aromatic and araliphatic ketones such as e.g. acetophenone; 4-methylacetophenone; 4-methoxyacetophenone; 4-tert.-butyl-2,6-dimethylacetophenone; 4-phenyl-2-butanone; 4-(4-hydroxyphenyl)-2-butanone; 1-(2-naphthalenyl)ethanone; 2-benzofuranylethanone; (3-methyl-2-benzofuranyl)ethanone; benzophenone; 1,1,2,3,3,6-hexamethyl-5-indanylmethylketone; 6-tert.-butyl-1,1-dimethyl-4-indanylmethylketone; 1-[2,3-dihydro-1,1,2,6-tetramethyl-3-(1-methylethyl)-1h-5-indenyl]ethanone; 5',6',7',8'-tetrahydro-3',5',5',6',8',8'-hexamethyl-2-acetonaphthone; arouratic and araliphatic carboxylic acids and their esters such as e.g. benzoic acid; phenylacetic acid; methylbenzoate; ethylbenzoate; hexylbenzoate; benzyl-benzoate; methylphenylacetate; ethylphenylacetate; geranylphenylacetate; phenylethyl-phenylacetate; methylcinnmate; ethylcinnamate; benzylcinnamate; phenylethylcinnamate; cinnamylcinnamate; allylphenoxyacetate; methylsalicylate; isoamylsalicylate; hexylsalicylate; cyclohexylsalicylate; cis-3-hexenylsalicylate; benzylsalicylate; phenylethylsalicylate; methyl-2,4-dihydroxy-3,6-dimethylbenzoate; ethyl-3-phenylglycidate; ethyl-3-methyl-3-phenylglycidate; nitrogenous aromatic compounds such as 2,4,6-trinitro-1,3-dimethyl-5-tert.-butylbenzol; 3,5-dinitro-2,6-dimethyl-4-tert-butylacetophenone; cinnamic acid nitrile; 3-methyl-5-phenyl-2-pentensaurenitrile; 3-methyl-5-phenylpentansaurenitrile; methylanthranilate; methy-n-methylanthranilate; schiff bases of methylantranilate with 7-hydroxy-3,7-dimethyloctanal, 2-methyl-3-(4-tert.-butylphenyl)propanal or 2,4-dimethyl-3-cyclohexencarbaldehyde; 6-isopropylchinoline; 6-isobutylchinoline; 6-sec.-butylchinoline; 2-(3-phenylpropyl)pyridine; indol; skatol; 2-methoxy-3-isopropylpyrazine; 2-isobutyl-3-methoxypyrazine; phenols, phenyl ethers and phenyl esters such as e.g. estragol; anethol; eugenol; eugenylmethyl ether; isoeugenol; isoeugenylmethyl ether; thymol; carvacrol; diphenyl ether; betanaphthyl methyl ether; beta-naphthylethyl ether; beta-naphthylisobutyl ether; 1,4-dimethoxybenzol; eugenylacetate; 2-methoxy-4-methylphenol; 2-ethoxy-5-(1-propenyl)phenol; p-kresylphenylacetate; heterocyclic compounds such as e.g. 2,5-dimethyl-4-hydroxy-2h-furan-3-one; 2-ethyl-4-hydroxy-5-methyl-2h-furan-3-one; 3-hydroxy-2-methyl-4h-pyran-4-one; 2-ethyl-3-hydroxy-4h-pyran-4-one; lactones such as e.g. 1,4-octanolide; 3-methyl-1,4-octanolide; 1,4-nonanolide; 1,4-decanolide; 8-decen-1,4-olide; 1,4-undecanolide; 1,4-dodecanolide; 1,5-decanolide; 1,5-dodecanolide; 4-methyl-1,4-decanolide; 1,15-pentadecanolide; cis- and trans-11-pentadecene-1,15-olide; cis- and trans-12-pentadecene-1,15-olide; 1,16-hexadecanolide; 9-hexadecene-1,16-olide; 10-oxa-1,16-hexadecanolide; 11-oxa-1,16-hexadecanolide; 12-oxa-1,16-hexadecanolide; ethylen-1,12-dodecandioate; ethylen-1,13-tridecandioate; coumarin; 2,3-dihydrocoumarin; and octahydrocoumarin.

Furthermore, the fragrances, particularly perfume oils, can be adsorbed to a carrier, which ensures a fine distribution of the therein included fragrances in the product as well as a controlled release when used. Such carriers can be porous inorganic materials such as leichtsulfat, silica gel, zeolites, gypsum, clays, aerosil, clay granulates, aerated concrete or gas concrete etc. Or organic materials such as woods, cellulose based substances sugar, dextrines (e.g. maltodextrin) or synthetic materials such as PVC, polyvinyl acetates or poly urethanes.

The active substance(s), particularly the fragrances, as e.g. perfume oils, can exist in a microencapsulated or spray dried form or as inclusion complexes or as extrusion products.

Cleaning-active and/or protective substances or surfactants are known to the person skilled in the art and include anionic, cationic, non-ionic and amphoteric surfactants or combinations thereof. Surfactants are amphiphilic substances, which can solubilise organic, non-polar substances in water. The hydrophilic proportions of a surfactant molecule are usually polar functional groups, e.g. —COO—, —$OSO_3^{2-}$, and —$SO^{3-}$, whereas the hydrophobic proportions are usually nonpolar carbohydrate rests. Surfactants are generally classified according to class and charge of the hydrophilic molecule proportion. Hereby four groups can be distinguished; anionic surfactants, cationic surfactants, amphoteric surfactants and non-ionic surfactants.

Anionic surfactants usually share as functional groups carboxylate, sulphate or sulphonate groups. In aqueous solution they form negatively charged organic ions in the acidic or neutral milieu. Cationic surfactants are almost exclusively classified by the presence of a quarternary ammonium group. In aqueous solution they form positively charged organic ions in the acidic or neutral milieu. Amphoteric surfactants contain both, anionic and cationic groups and thus behave in aqueous solution as anionic or cationic surfactants, depending on the pH. In the strongly acidic milieu they are positively charged, whereas in the alkaline mileu they are negatively charged. In the neutral pH range however, they are zwitterionic. Typical for non-ionic surfactants are polyether chains. Non-ionic surfactants do not form ions in aqueous medium.

Advantageously used anionic surfactants are acylamino acids (and their salts), such as acyl glutamates e.g. sodium acyl glutamate, Di-TEA-palmitoyl-aspartate and sodium capryl/capringlutamate; acyl peptides such as palmitoyl-hydrolyzed milk protein, sodium cocoyl-hydrolyzed soy protein and sodium/potassium cocoyl-hydrolyzed collagen; sarcosinates such as myristoyl sarcosin, TEA-lauroylsarcosinate, sodium lauorylsarcosinate and sodium cocoylsarcosinate; taurates such as sodium lauroyltaurate and sodium methylcocoyltaurate; acyllactylates, lauroyllactylate, caproyllactylate; alaninate, carboxylic acids and derivatives such as lauric acid, aluminium stearate, magnesium alkanolate, zinc undecylenate; ester carboxylic acids such as calcium stearoyllactylate, laureth-6 citrate and sodium PEG-4 lauramidcarboxylate; ether carboxylic acids such as sodium laureth-13 carboxylate and sodium PEG-6 cocamide carboxylate; phosphoric acid esters and salts such as DEA-oleth-10-phosphate and dilaureth-4 phosphate; sulphonic acids and salts such as acyl-isothionates, e.g. sodium/ammonium cocoyl-isethionate; alkylarylsulphonates; alkylsulphonates such as sodium cocosmonoglyceridsulphate, sodium C12-14 olefinsulphonate, sodium laurylsulphoacetate and magnesium PEG-3 cocamidsulphate; sulphosuccinate such as dioctylsodium sulphosuccinat, disodium laurethsulphosuccinat, disodium laurylsulphosuccinate and disodium undecylenamido MEA-sulphosuccinate; as well as sulphuric acid esters such as alkylethersulphate e.g. sodium, ammonium, magnesium, MIPA, TIPA laurethsulphate, sodium myrethsulphate and sodium C12-113 parethsulphate; alkylsulphates e.g. sodium, ammonium and TEA-laurylsulphate. Hansanol NS 242 of the Hansa Group AG is a preferred anionic surfactant.

Advantageously used cationic surfactants are alkylamines, alkylimidazoles, ethoxylated amines and quarternary surfactants. $RNH_2CH_2CH_2COO^-$ (at pH=7) $RNHCH_2CH_2COO^-B^+$ (at pH=12)$B^+$=arbitrary cation, e. g. Na+-Esterquats.

Esterquats generally base on quarternary triethanolmethy-ammonium or quarternary diethanol-dimethyl-ammonium compounds. The required, long carbohydrate chains are attached as fatty acid esters. These are easily separated during the biological degradation, which is very advantageous for the degradation at least as a first step. Preferred esterquats comprise for example Rewoquat WE 18 (Evonic Goldschmidt GmbH). Esterquats can also serve as plasticizers.

Quarternary surfactants contain at least one N-atom, which is covalently bound to 4 alkyl or aryl groups. This results, independent of the pH value, in a positive charge. Advantageous are alkylbetaine, alkylamidopropylbetaine and alkylamidopropylhydroxysulphaine.

The used cationic surfactants can further be chosen preferably of the group of quarternary ammonium compounds, particularly benzyltrialkylammonium chlorides or bromides, such as benzyldimethylstearyl-ammonium chloride, further alkyltrialkylammonium salts, such as cetyltrimethylammonium chloride or bromide, alkyldimethylhydroxyethylammonium chloride or bromide, dialkyldimethylammonium chloride or bromide, alkylamidethyltrimethylammonium ether sulphates, alkylpyridinium salts such as lauryl or cetylpyrimidinium chloride, imidazolin derivatives and compounds with cationic character such as aminoxides e.g. alkyldimethylamin oxides or alkylaminoethyldimethylamin oxides. Cetyltrimethylammonium salts are particularly preferred.

Advantageously used amphoteric surfactants are Acyl-/dialkylethylendiamine, such as sodium acylamphoatetate, disodium acylamphodipropionate, disodium alkylamphodiacetate, sodium acylamphohydroxy-propylsulphonate, disodium acylamphodiacetate and sodium acylamphopropionate; N-alkyl amino acids such as aminopropylalkyl glutamide, alkylamino propionic acid, sodium alkyl iminodipropionate and lauroamphocarboxy glycinate.

Advantageously used non-ionic tensides are Alkohols; Alkanolamides such as Cocamide MEA/DEA/MIPA; Aminoxides such as Cocoamidopropylaminoxide; esters, which arise by esterification of carboxylic acids with Ethylenoxide, Glycerin, Sorbitan or other alcohols; Ethers such as ethoxylated/propoxylated alcohols, ethoxylated/propoxylated esters, ethoxylated/propoxylated glycerine esters, ethoxylated/propoxylated cholesterins, ethoxylated/propoxylated triglyceride esters, ethoxylated/propoxylated lanolin, ethoxylated/propoxylated polysiloxanes, propoxylated POE-ethers and alkylpolyglycosides such as laurylglucoside, decylglycoside and cocoglycoside; sucrose esters; ether; polyglycerine esters such as diglycerine esters, monoglycerin esters; methylglucose esters; esters of hydroxyl acids.

The use of a combination of one, two, three, four or more anionic and/or amphoteric surfactants with one or more non-ionic surfactants is further advantageous.

Further suitable surfactants can be found in e.g. US 2016/304813 A1, DE 102013205092 A1 DE 102012203989 A1, DE 102012203986 A1, DE 19919088 A1 and DE 10019142 A1.

Functional agents can be e.g. plasticizers. Suitable plasticizers or substances for inhibition of clogging (detactifiers) are for example lanoline, stearic acid, sodium stearate, ethyl acetate, diacetine (glycerine diacetate), triacetine (glycerine triacetate), triethylcitrate, and a combination thereof. Furthermore, esters of resin acids can be used, for example esters of lower aliphatic alcohols or polyols with completely or partially hardened, monmeric or oligomeric resin acids. Methyl, glycerine or pentareythrit esters as well as their mixtures are particularly used for this purpose. Alternatively, terpene resins, which can be derived from alpha-pinenes, beta-pinenes, delta-limonenes or other mixtures, can be considered. Further plasticizers are listed in the WO 2005/123101 and can be used according to the present invention.

A possibility to yield high portions of active substances, especially fragrances, in the active substance wafers according to the invention, is the use of microencapsulated active substances, particularly of fragrances. Such microcapsules can be added to the water-soluble polyvinyl alcohol, which is solved in a solvent, at the production of the active substance wafer according to the invention. The obtained dispersion can be readily processed as usual to obtain the active substance wafer according to the invention.

The capsules are generally finely dispersed, liquid or solid phases, coated with film-forming polymers, wherein at the production of these the polymers deposit on the material to be covered after emulsification and coacervation or surface polymerization. According to another method, molten waxes which can, as microparticles, further be covered with film-forming polymers are received by a matrix ("microsponge"). According to a third method, particles are alternatingly coated with polyelectrolytes with different charge ("layer-by-layer"-method). The microscopically small capsules can be dried like powder. In addition to mononuclear microcapsules, polynuclear aggregates, also called microspheres, are known, which contain two or more nuclei distributed in the continuous shell material. Mono or polynuclear microcapsules can further be enclosed by an additional second, third, etc. shell. The shell can consist of natural, semi-synthetic or synthetic materials. Natural shell materials are for example gum arabic, agar-agar, agarose, maltodextrines, alginic acid or the salts thereof, e.g. sodium or calcium alginate, fats and fatty acids, cetyl alcohol, collagen, chitosane, lecithine, gelatine, albumin, shellac, polysaccharides, such as starch or dextran, polypeptides, protein hydrolysates, sucrose and waxes. Semi-synthetic shell materials are among other chemically modified celluloses, particularly cellulose esters and ethers, e.g. Cellulose acetate, Ethylcellulose, Hydroxypropylcellulose, Hydroxypropylmethylcellulose and Carboxymethylcellulose, as well as starch derivatives, especially starch ethers and esters. Synthetic shell materials are for example polymers such as polyacrylates, polyamides, polyvinyl alcohols or polyvinylpyrrolidone.

Examples for microcapsules of prior art are the following commercial products (the shell material is listed in brackets): Hallcrest microcapsules (gelatine, gum arabic), Coletica Thalaspheres (maritime collagen), Lipotec millicapsules (alginic acid, agar-agar), Induchem Unispheres (lactose, microcrystalline cellulose, hydroxypropylmethylcellulose); Unicerin C30 (lactose, microcrystalline cellulose, hydroxypropylmethylcellulose), Kobo Glycospheres (modified starch, fatty acid esters, phospholipids), Softspheres (modified agaragar) and Kuhs Probiol Nanospheres (phospholipids) as well as Primaspheres and Primasponges (chitosan, alginates) and Primasys (phospholipids).

Chitosan microcapsules and methods for their production are sufficiently known from prior art (WO01/01926, WO01/01927, WO01/01928, WO01/01929). Microcapsules with average diameter in a range of 0.0001 to 5, preferably 0.001 to 0.5 and particularly preferably 0.005 to 0.1 mm, consisting of a shell membrane and a matrix containing the active ingredients, can for example be obtained by (a) preparing a matrix from gelling agents, cationic polymers and active ingredients, (b) where applicable, dispersing the matrix in an oil phase and (c) treatment of the dispersed matrix with aqueous solutions of anionic polymers and thereby, if necessary, removal of the oil phase.

Preferred capsule systems are listed in EP3061500 or WO2016/134884. SymCap products of Symrise AG, particularly SymCap G, are particularly preferred.

According to another embodiment, the additive is selected from the group consisting of a filler, a disintegrant, a binder, an absorber, an antimicrobial, a dye, and a combination thereof.

Magnesium or calcium carbonate, ground pumice stone, silicates, particularly magnesium or aluminium silicates, especially calcium silicates, clays, aluminium oxides, talc, titan dioxide, mono, di and tricalciumphosphate as well as cellulose polymers can be considered as fillers. A sugar, e.g. glucose or fructose, can also be used.

To facilitate the disintegration of the active substance wafer, it is possible to incorporate disintegration tools, so called disintegrants, in these materials to shorten the disintegration times. Disintegrants or disintegration accelerators are generally understood as tools providing a rapid disintegration, especially of tablets, in water or other media and rapid release of the active substances. These substances, also being called "exploders" due to their effect, increase their volume when water is added, wherein on the one hand the tare volume is increased (swelling) and on the other hand further pressure is obtained by the release of gases, which disintegrates the tablet into smaller particles. Known disintegration tools are for example carbonate/citric acid systems, wherein also other organic acids can be used. Swelling disintegration tools are for example synthetic polymers such as polyvinylpyrrolidone (PVP) or natural polymers or modified natural materials such as cellulose and starch and its derivatives, alginates or casein derivatives.

Disintegrants based on cellulose are used as preferred disintegrants. Pure cellulose shares the formal gross composition (C6H1005)n and formally represents a beta-1,4-polyacetate of cellobiose, which in turn is build up of two molecules of glucose. Suitable celluloses thereby consist of approximately 500 to 5,000 glucose units and thus have average molar masses of 50,000 to 500,000. Cellulose derivatives, which are obtainable by polymeric analogous reactions of cellulose, can also be used as disintegration tools based on cellulose according to the present invention. Such chemical modified celluloses thereby comprise for example products of esterifications or etherifications, in which hydroxyl groups were substituted by hydrogen atoms. But also celluloses, in which the hydroxyl groups were substituted with functional groups, not bound via an oxygen atom, can be used as cellulose derivatives. The group of cellulose derivatives includes for example alkali celluloses, carboxymethyl cellulose (CMC), cellulose esters and ethers as well as amino celluloses.

The listed cellulose derivatives are preferably used as disintegration tools, which are not solely based on cellulose, but in a mixture with cellulose. The content of cellulose derivatives of these mixtures is preferably below 50 wt.-%, particularly preferably below 20 wt.-% with regard to the disintegration tool based on cellulose. Pure cellulose, free of cellulose derivatives, is particularly preferably used as disintegration tool based on cellulose.

The cellulose being used as disintegrant is preferably not used as fine-particled form, but is converted into a gross form before being added to the premixes to be pressed, for example by granulation or compacting. The particle sizes of such disintegration tools are mostly higher than 200 μm, preferably for at least 90 wt.-% between 300 and 1,600 μm and especially for at least 90 wt.-% between 400 and 1,200 μm.

As further disintegrant based on cellulose or as part of this component, microcrystalline cellulose can be used. This microcrystalline cellulose is obtained by partial hydrolysis of celluloses under such conditions that only attack and completely dissolve the amorphous parts (approx. 30% of the total amount of cellulose) of the celluloses, whereas the crystalline parts (approx. 70%) remain intact. A following disaggregation of the micro-fine celluloses obtained by the hydrolysis provides the microcrystalline celluloses showing primary particle sizes of approx. 5 μm and being compactable to for example granulates with an average particle size of 200 μm.

Furthermore and according to the invention, gas producing effervescent systems can preferably be used. The gas producing effervescent system can consist of one substance, which releases a gas when getting in contact with water. Especially magnesium peroxide is to be mentioned among these compounds, which releases oxygen when getting in contact with water. However, the gas releasing effervescent system itself usually consists of at least two components, which react with each other while producing a gas. While a variety of systems is conceivable and possible at this point, which release for example nitrogen, oxygen or hydrogen, the effervescent system used in the washing and cleaning agents can be selected by means of economical as well as ecological aspects. Preferred effervescent systems consist of alkali metal carbonate and/or hydrogen carbonate as well as an acidification tool, suitable for releasing carbon dioxide from the alkali metal salts in aqueous solution.

As a binder, any substance which is usually used for the production of such formulation can be used, e.g. tragacanth, starch. The binder can be present in the formulation in an amount from 0.5 to 1.5 wt.-% of the total amount (or parts by weight).

To improve the washing permanence of the equipment according to the invention, fixating the amylase containing substance with a binder on the textile has been proven successful. As binders, both, film-forming, water-insoluble polymers and low-molecular reactive substances, which polymerize when heated, can be considered. Usually, the binder is applied in an amount that the weight ratio of amylase containing substance to water-insoluble polymer is in a range of 1:1 to 100:1, preferably in a range of 1.5:1 to 50:1 and particularly preferably in a range of 2:1 to 20:1.

Usually, the film-forming polymers are applied in form of an aqueous dispersion of fine-particled polymer particles. For a successful application according to the invention, the particle size is of minor importance. It usually is, however, below 5 (average weight) and usually amounts 50 nm to 2 μm.

The film-forming polymer can particularly have a glass transition temperature TG in the range of −40° C. to +100° C., preferably −30° C. to +60° C., particularly preferably −20° C. to +40° C. As far as the polymeric binder comprises several polymer components, at least the main component should have a glass transition temperature in this range. The glass transition temperature of the main component is particularly in a range of −30° C. to +60° C. and particularly preferred in a range of −20° C. to +40° C. Preferably, all polymeric components have a glass transition temperature in these ranges. The indicated glass transition temperatures thereby refer to the "midpoint temperature" which was determined via DSC according to ASTM-D 3418-82. If the binders may be cross-linking, the glass transition temperature refers to the non-cross-linked state.

Examples for suitable film-forming polymers base on the following polymer classes: (1) polyurethane resins; (2) acrylate resins (pure acrylates: copolymers from alkylacrylates and alkylmethacryltates); (3) styrene acrylates (copolymers from styrene and alkylacrylates); (4) styrene/butadiene copolymerisates; (5) polyvinyl esters, particularly polyvinyl acetates and copolymers of vinyl acetate with vinyl propionate; (6) vinyl ester olefin copolymers, e.g. vinyl acetate/ethylene copolymers; (7) vinyl ester acrylate copolymers, e.g. vinyl acetate/alkylacrylate copolymers as well as vinyl acetate/alkylacrylate/ethylene terpolymers.

Such polymers are known and available on the market, e.g. polymers of classes (2) to (7) in form of aqueous dispersions labelled ACRONAL, STYROFAN, BUTOFAN (BASF-AG), MOWILITH, MOWIPLUS, APPRETAN (Clariant), VINNAPAS and VINNOL (WACKER). Aqueous polyurethane dispersions (1) suitable for the method according to the invention are particularly such that can be used for laminating textiles (see e.g. J. Hemmrich, Int. Text. Bull. 39, 1993, No. 2, p. 53-56; "Wässrige Polyurethan-Beschichtungssysteme" Chemiefasern/Textilind. 39 91 (1989) T149, T150; W. Schröer, Textilveredelung 22, 1987, p. 459-467). Aqueous polyurethane dispersions are available on the market, e.g. under the trade names Alberdingk of Alberdingk, Impranil of BAYER AG, Permutex of Stahl, 15 Waalwijk, Netherlands, or of BASF SE, or can be produced according to known methods as they are for example described in "Herstellverfahren für Polyurethane" in Houben-Weyl, "Methoden der organischen Chemie", Vol. E 20/Makromolekulare Stoffe, p. 1587, D. Dietrich et al., Angew. Chem. 82 (1970), p. 53 ff., Angew. Makrom. Chem. 76, 1972, p. 85 ff. and Angew. Makrom. Chem. 98, 1981, 133-165, Progress in Organic Coatings, 9, 20 1981, p. 281-240, or Römpp Chemielexikon, 9. Edition, Volume 5, p. 3575.

The film-forming polymers can cross-link themselves, i.e. the polymers have functional groups (cross-linkable groups), which react with each other, with the functional groups of the amylose or with a low-molecular cross-linker while forming a bond, when the composition is dried, or heated where appropriate. Further examples of suitable compounds can be found in DE102010002558.

Suitable absorbers can for example be found in EP816484. Different substances, especially inorganic substances, can be used for the adsorption of the active substances, especially fragrances. Alternatively, organic substances as for example sodium xylolsulphonate can be used.

Skin protecting or skin caring substances are known to the person skilled in the art.

It can be advantageous to use one or more antimicrobials. Preferably selected antimicrobials are benzoic acid, its esters and salts, propionic acid and its salts, salicylic acid and its salts, 2,4-hexadiene acid (sorbic acid) and its salts, formaldehyde and paraformal-dehyde, 2-hydroxybiphenylether und seine salze, 2-zinksulfidopyridin-n-oxid, anorgani-sche sulfite und bisulfite, natriumiodat, chlorbutanolum, 4-ethylquecksilber-(ii)5-amino-1,3-bis(2-hydroxy benzoic acid, its salts and esters, dehydroacetic acid, formic acid, 1,6-bis(4-amidino-2-bromphenoxy)-n-hexan and its salts, the sodium salt of ethylmercury-(ii)-thiosalicylic acid, phenylmercury and its salts, 10-undecylenic acid and its salts, 5-amino-1,3-bis(2-ethylhexyl)-5-methylhexahydropyrimidine, 5-bromine-5-nitro-1,3-dioxane, 2-bromine-2-nitro-1,3-propandiol, 2,4-dichloro benzyl alcohol, n-(4-chlorophenyl)-n'-(3,4-dichlorophenyl)-urea, 4-chlor-m-kresol, 2,4,4'-trichlor-2'-hydroxy-diphenyl ether, 4-chlor-3,5-dimethylphenol, 1,1'-methylen-bis(3-(1-hydroxymethyl-2,4-dioximidazolidin-5-yl)urea), poly-(hexamethylenediguanide)-hydrochloride, 2-phenoxyethanol, hexamethylene tetramine, 1-(3-chloroallyl)-3,5,7-triaza-1-azonia-adamantane chloride, 1(4-chlorophenoxy)l(1h-imidazol-1-yl)-3,3-dimethyl-2-butanon, 1,3-bis-(hydroxy-methyl)-5,5-dimethyl-2,4-imidazolidindion, benzyl alcohol, octopirox, 1,2-dibromine-2,4-dicyanobutan, 2,2'-methylene-bis(6-bromine-4-chlorophenol), bromochlorophene, mixture of 5-chloro-2-methyl-3(2h)-isothiazolinon and 2-methyl-3(2h)isothiazlinon with magnesium chloride and magnesium nitrate, 2-benzyl-4-chlorophenol, 2-chloroacetamide, chlorhexidine, chlorhexidine acetate, chlorhexidine gluconate, chlorhexidine hydrochloride, 1-phenoxypropan-2-ol, n-alkyl(c12-c22)trimethyl-ammoniumbromide and -chloride, 4,4-dimethyl-1,3-oxazolidine, n-hydroxymethyl-n-(1,3-di(hydroxymethyl)-2,5-dioxoimidazolidine-4-yl)-n'-hydroxy-methyl urea, 1,6-bis(4-amidinophenoxy)-n-hexan and its salts, glutaraldehyde, 5-ethyl-1-aza-3,7-dioxabicyclo(3.3.0)octan, 3-(4-chlorphenoxy)-1,2-propanediol, hyamine, alkyl-(c8-c18)-dimethyl-benzylammoniumchloride, alkyl-(c8-c18)-dimethylbenzylammonium-bromide, alkyl-(c8-c18)-dimethylbenzyl-ammoniumsaccharinate, benzylhemiformal, 3-iodine-2-propinyl-butylcarbamate, sodium-hydroxymethyl-aminoacetate or sodium-hydroxymethyl-aminoacetate. Further examples of suitable antimicrobials can be found in DE102011085798.

The additives can include dyes and their lacquers. These are preferably food colorants, as they necessarily need to be toxicologically and dermatologically harmless. The approved food colorants include E 129 to E 161: allura red AC E 129 rot; aluminium E 173; amaranth E 123 rot; anthocyane E 163 violet, blue; Azorubine E 122 red; betanine E 162 red; brown FK E 154 yellowish brown; brown HT E 155 red brown; brilliant blue FCF E 133 blue; brilliant black BN E 151 violet, brown, black; calciumcarbonate E 170; canthaxanthine E 161 g; carotin; *annatto (norbixin); *capsanthine; *lycopine; *8'-apo-βcaroten-8'-al; *ethyl-8'-apo-&bgr;-caroten-8'-oate E 160 a; E 160 b; E 160 c; E 160 d; E 160 e; E 160 f; chinoline yellow E 104; chlorophyll E 140 green; cochenile ret A E 124; curcumin E 100; iron oxide E 172; erythrosine E 127; yellow-orange S E 110; gold E 175; green S E 142; indigotine E 132; cochineal E 120; copper containing complexes of chlorophylls and chlorophyllines E 141; lactoflavin E 101; litholrubine BK E 180; lutein E 161 b; patent blue V E 131; vegetable carbon E 153; riboflavine (vitamin B2); *riboflavine-5-phosphate E 101; E 101 a; Safflower cherry red to brown-yellow; silver E 174; tartrazine E 102; titanium dioxide E 171; caramel colour; *Sulphite lye-caramel colour; *Ammoniac-caramel colour; *Ammon sulphite-caramel colour E 150 a; E 150 b; E 150 c; E 150 d; and Zeaxanthine E 161 h. Suitable dyes can additionally be found in DE202013006887.

In addition to food colorants, further dyes can be used, which are not listed above, but are approved by the FDA in the USA. Further, cosmetic dyes can be used. Particularly preferred are dyes fluorescing in black light or UV light, such as optical brighteners.

According to a preferred embodiment, 3 to 12 wt.-% (or parts by weight) of water-soluble polyvinyl alcohol are contained by the active substance wafer. Therefore, 4 to 11 wt.-% (or parts by weight), 5 to 10 wt.-% (or parts by weight), 6 to 9 wt.-% (or parts by weight), or 7 to 8 wt.-% (or parts by weight) of the water-soluble polyvinyl alcohol can be included in the active substance wafer. Preferably, however, 5 to 8 wt.-% (or parts by weight) of the water-soluble polyvinyl alcohol are contained by the active substance wafer.

According to a further embodiment, 5 to 15 wt.-% (or parts by weight), e.g. 6 to 14 wt.-% (or parts by weight), 7 to 13 wt.-% (or parts by weight), 8 to 12 wt.-% (or parts by weight), 9 to 11 wt.-% (or parts by weight) or 10 wt.-% (or parts by weight) of active substance are contained by the active substance wafer. Preferably, however, 7 to 10 wt.-% (or parts by weight) of the active substance are contained by the active substance wafer.

According to an even further embodiment, the active substance wafer contains 5 to 10 wt.-% (or parts by weight) of water-soluble polyvinyl alcohol, 7 to 15 wt.-% (or parts by weight) of a fragrance, optionally 2 to 5 wt.-% (or parts by weight) of starch, and optionally 1 to 8 wt.-% (or parts by weight) of an additive. Preferably, the active substance wafer contains 5 to 8 wt.-% (or parts by weight) of water-soluble polyvinyl alcohol, 7 to 8 wt.-% (or parts by weight) of a fragrance, optionally 2 to 3 wt.-% (or parts by weight) of starch, and 1 to 4 wt.-% (or parts by weight) of an additive.

Preferred mixtures according to the invention for producing active substance wafers, preferably active substance wafers according to the invention as described herein, comprise or consist of:

(a) 10 wt.-% of a water-soluble polyvinyl alcohol, especially polyvinyl alcohol, 1.5 to 2 wt.-% of a filler, e.g. calcium silicate, 10 wt.-% of a fragrance, especially a perfume oil, and ad 100 wt.-% ethanol:water (60 wt.-%:40 wt.-%); or (b) 10 wt.-% of a water-soluble polyvinyl alcohol, especially polyvinyl alcohol, 1.5 to 2 wt.-% of a filler, 10 wt.-% of a first fragrance, especially a perfume oil, 2 wt.-% of a second fragrance, especially a perfume oil, and ad 100 wt.-% ethanol:water (60 wt.-%:40 wt.-%); or (c) 10 wt.-% of a water-soluble polyvinyl alcohol, especially polyvinyl alcohol, 3 wt.-% of a water-insoluble polymer, e.g. starch, 10 wt.-% of a first filler, e.g. sugar, 2.5 wt.-% of a second filler, e.g. calcium silicate, and 15 wt.-% of a fragrance, especially a perfume oil, and ad 100 wt.-% ethanol:water (30 wt.-%:70 wt.-%); or (d) 5 wt.-% of a water-soluble polyvinyl alcohol, especially polyvinyl alcohol, 3 wt.-% of a water-insoluble polymer, e.g. starch, 10 wt.-% of a filler, e.g. sugar, and 15 wt.-% of a cleaning agent, especially sodium laurylsulphate, and ad 100 wt.-% ethanol:water (30 wt.-%:70 wt.-%); or (e) 5 wt.-% of a water-soluble polyvinyl alcohol, especially polyvinyl alcohol, 10 wt.-% of a filler, e.g. sugar, and 15 wt.-% of a cleaning agent, especially sodium laurylsulphate, and ad 100 wt.-% ethanol:water (60 wt.-%:40 wt.-%); or (f) 5 wt.-% of a water-soluble polyvinyl alcohol, especially polyvinyl alcohol, 3 wt.-% of a water-insoluble polymer, e.g. starch, 10 wt.-% of a filler, e.g. sugar, and 5 wt.-% of a cleaning agent or plasticizer, especially Rewoquat WE 18, and ad 100 wt.-% ethanol:water (30 wt.-%:70 wt.-%); or (g) 5 wt.-% of a water-soluble polyvinyl alcohol, especially polyvinyl alcohol, 3 wt.-% of a water-insoluble polymer, e.g. starch, 10 wt.-% of a filler, e.g. sugar, 1 wt.-% of a capsule system, especially SymCap G, 1 wt.-% of a filler, especially calcium silicate, and 5 wt.-% of a fragrance, especially a perfume oil, and ad 100 wt.-% ethanol:water (30 wt.-%:70 wt.-%).

If in the scope of the present invention it is referred to the dimensions of a particle or a length, e.g. a layer thickness, which are in a range of ≤500 μm, the following methods are preferably applied to determine the dimension or length. In case a diameter of a particle is mentioned, it refers to the median diameter. This median diameter is preferably determined with a Coulter counter according to ISO 13319:2007. In the scope of the present invention, a Beckman Coulter Multisizer 3 can be used, wherein the measurements are performed according to the manufacturer specifications. Layer thicknesses or length measurements can be determined by white-light interferometry according to EN ISO 25178. In the scope of the present invention, a Bruker VSI Contour KO is used. The measurements are performed according to the manufacturer specifications.

The carrier material, which is used in the method according to the invention, is not limited. It can be for example a metal, e.g. aluminium or stainless steel, a water-insoluble polymer, e.g. polyethylene or polypropylene, or glass. The previously mentioned materials can be coated or uncoated. A coating can be specialized to easily and residue-freely detach the specialized active substance wafer from the carrier material. Preferred carrier materials are metal or plastic coated with melamine, e.g. stainless steel coated with melamine or aluminium coated with aluminium, or uncoated glass. If water-insoluble polymers are used, they can simultaneously serve as packaging material.

The mixture applied on the carrier material for the production of the active substance wafer additionally has 2.0 to 20.0 wt.-% of the water-soluble polyvinyl alcohol, 1.0 to 20.0 wt.-% of the active substance, 0 to 5.0 wt.-% of the water-insoluble polymer, and 0 to 10.0 wt.-% of the additive of one or more suitable solvents. Thus, 45.0 to 97.0 wt.-% of solvent are included.

It is obvious that one or more solvents can be used. Suitable solvents comprise for example water, n-propanol, i-propanol, ethanol, and/or methanol. If several solvents are used in combination, preferably one of them is water.

Further preferably, the solvent of the mixture according to the invention comprises, based on 100 wt.-% of the solvent, 30 to 70 wt.-% of water and 30 to 70 wt.-% of ethanol, preferably 40 to 60 wt.-% of water and 40 to 60 wt.-% of ethanol, particularly preferably 45 to 55 wt.-% of water and 45 to 55 wt.-% of ethanol, with regard to 100 wt.-% of the solvent. Further preferably, the solvent consists of 30 to 70 wt.-% of water and 30 to 70 wt.-% of ethanol, preferably 40 to 60 wt.-% of water and 40 to 60 wt.-% of ethanol, particularly preferably 45 to 55 wt.-% of water and 45 to 55 wt.-% of ethanol, with regard to 100 wt.-% of the solvent. In case a film of only polyvinyl alcohol is used, the solvent preferably is consists of water and ethanol in a 40:60 ratio, with regard to 100 wt.-% of the solvent. In case a film of only polyvinyl alcohol and starch is used, the solvent preferably is consists of water and ethanol in a 70:30 ratio, with regard to 100 wt.-% of the solvent.

For producing the mixture, usually and initially 1.0 to 50.0 wt.-%, preferably 2.0 to 20.0 wt.-%, of the water-soluble polyvinyl alcohol (of the water-soluble polyvinyl alcohols) are mixed with the required amount (45.0 to 97.0 wt.-%) of solvent. This can be achieved by any method known to the person skilled in the art. For instance, the water-soluble polyvinyl alcohol can be added to the solvent at once, in several steps or continuously. Preferably, the mixture is thereby mixed homogenously. This can be achieved by a suitable stirrer, e.g. a KPG-stirrer.

After dissolving the water-soluble polyvinyl alcohol (of the water-soluble polyvinyl alcohols), the other substances, i.e. the active substance(s) and the additive(s) are added in any desired chronological order or even simultaneously.

The production and/or the application of the mixture onto the carrier material can be performed at increased temperature to enable a sufficient consistency or processability e.g. flowability of the mixture. Preferably, the mixture is used or applied onto the carrier material at a temperature of 20° C. to 75° C., preferably 20° C. to 50° C., further preferably 20° C. to 25° C.

It is obvious that a mixture with completely dissolved water-soluble polyvinyl alcohol can also exist in several phases, due to the presence of other contained substances (1.0 to 20.0 wt.-% of active substance, 0 to 5.0 wt.-% of water-insoluble polymer and 0 to 10.0 wt.-% of additive), as these other substances do not necessarily show similarly well water-soluble properties as the water-soluble polyvinyl alcohol. If e.g. microencapsuled systems, especially microencapsuled fragrances, are present, this is fulfilled from the very beginning. Therefore, the mixture can be present e.g. as an emulsion or dispersion. The production of an active substance carrier with uniform properties, especially even distribution of all ingredients, is ensured by a sufficiently homogeneous mixing of the mixture, if necessary also directly before the application onto the carrier material.

The application of the mixture onto the carrier material as well as its potentially applied drying can be performed in various ways, which are known to the person skilled in the art. For example, the mixture can be sprayed or poured onto the carrier material, wherein in the second case a rolling operation may be necessary to evenly distribute the mixture on the carrier material.

Therefore, a film or layer can be obtained on the carrier material, with any desired thickness, e.g. 50 μm to 1 cm, preferably 100 μm to 500 μm, 200 μm to 450 μm, 250 μm to 400 μm, or 300 μm to 350 μm.

The active substance wafer preferably has a surface area of e.g. 0.1 $cm^2$ or more, e.g. 0.25 $cm^2$, 0.5 $cm^2$, 1.0 $cm^2$, 5.0 $cm^2$, 25.0 $cm^2$ or 100 $cm^2$ or more, wherein the thickness of the film or the layer can be selected from values as listed above.

The drying step can be accomplished by air curing, especially when thin layers of e.g. 50 μm to 300 μm are applied. Alternatively, e.g. a fan can be used.

The active substance wafer, which was applied on the carrier material in a way shown above, can be detached from the carrier material, be cut into a desired shape and be packed. Alternatively, the cutting of the active substance wafer can be performed directly on the carrier material.

According to a preferred embodiment, the layer is a first layer, wherein after creating the first layer, a second layer is applied onto the first layer and is dried. Hereby, the active substance wafer can be considered as such a first layer, but also the combination of first and second layer (and, optionally, further layers).

The second layer can be a protection layer, e.g. it can serve for packaging the active substance wafer by excluding moisture. Preferably, the same polymer material is used for the second layer and the carrier material. Therefore, the active substance wafer is positioned between two layers of water-insoluble polymer material.

Alternatively, the second layer can serve for controlled release of the substances of the first layer. For instance, the second layer can contain micropores, which allow the contact of a surface area of the active substance wafer with the environment. Preferably, the carrier material is hereby adapted to the second layer. The dissolution of the active substance wafer and the therein resulting release of the active substances can be slowed down by suitable dimensions, distribution and number of the micropores in the second layer and where applicable also on the carrier material. Such layers and their production are known to the person skilled in the art.

Preferably, a second layer is applied, which can also be based on an active substance wafer according to the invention. Consequently, a second laser is applied, which is normally based on (an)other active substance(s) and/or additive(s) than the first layer. Thereby, substances which potentially react with each other can be spatially separated and be included in an active substance wafer. Additionally, another water-soluble polyvinyl alcohol can be used to achieve different solution properties.

Likewise, two or more, e.g. three, four, five, six, seven, eight, nine, ten or more layers can be combined, out of which two or more, e.g. three, four, five, six, seven, eight, nine or ten layers are an active substance wafer according to the invention. Thus, different active substances and/or additives, also those being chemically incompatible, can be combined in different layers. These layers of active substances can exist directly next to each other or can be separated by a/several layer(s), which provide(s) a desired (e.g. slowed down) dissolution profile.

According to a special embodiment of the present invention, the active substance wafer according to the invention is used as an agent for laundry care, hand washing or dishwashing or within such products or as component of such products. The formulation of such agents for laundry care, hand laundry washing or dishwashing is well known to the person skilled in the art. Depending on the kind of use, skin protecting or skin caring compounds and/or additives can be used herein.

The hand laundry washing agent can particularly be a hygienic composition. Usually, the hygienic composition is used for the application on skin or hair.

The term "consist of" or "consisting of" describes, in the scope of the present invention, an exhaustive enumeration and excludes, apart from the explicitly mentioned components or steps, any further component or step.

The term "essentially consist of" or "essentially consisting of" describes, in the scope of the present invention, a partially exhaustive enumeration and describes compositions, which, in addition of the mentioned components, only include such further components, which do not substantively change the character of the composition or are present in amounts which do not substantively change the character of the composition.

Further features and advantages of the invention result from the subsequent description of preferred application examples.

EXAMPLES

The water-soluble polyvinyl alcohol (PVOH) is dissolved in aqueous, ethanolic solution and the further ingredients (see below) are added. The required temperature to dissolve the polymer is in a range from 20° C. to 75° C. The mixture is stirred until a homogeneous mixture is obtained. Fragrance wafers were poured on plates of stainless steel coated with melamine or glass plates and, if necessary, dried before packaging.

The dissolution of the fragrance wafers differs from example to example, depending on the used polymers. To determine the velocity of dissolution, a fragrance wafer is added to 200 ml tap water at a temperature of 24° C. and stirred at 270 rpm with a KPG-stirrer. The dissolution of the fragrance wafer varies in a range of 10 to 30 min. Fragrance wafers containing starch do not completely dissolve in tap water.

96% ethanol of different producers can be used. Usual tap water, preferably partially or completely deionised water (different producers) can be used as water. Further ingredients are calcium silicate (Florite R, different producers), perfume oils (different producers), completely gelatinized potato starch (Prejel of DFE Pharma), sugar (glucose, different producers), Hansanol NS 242 conc. (Hansa Group AG) and Rewoquat WE 18 (Evonic Goldschmidt GmbH).

Example 1

| | Experiment | |
|---|---|---|
| | 1 | 2 |
| Component | Wt. % | |
| PVOH | 10 | 10 |
| Ethanol:Water (60:40) | ad 100 | |
| Additional perfume oil | — | 2 |
| Calcium silicate | 1.5-2 | 1.5 |
| Perfume oil | 10 | 7 |
| Dissolution time in Min. | 30 | 30 |

Example 2

| Component | Wt. % |
|---|---|
| PVOH | 5 |
| Starch | 3 |
| Ethanol:Water (30:70) | ad 100 |
| Sugar | 10 |
| Calcium silicate | 2.5 |
| Perfume oil | 15 |
| Dissolution time in Min. | 14 |

Example 3

| | Experiment | |
|---|---|---|
| | 1 | 2 |
| Component | Wt. % | |
| PVOH | 5 | 5 |
| Starch | 3 | — |
| Ethanol:Water (30:70)/(60:40) | ad 100 (30:70) | ad 100 (60:40) |
| Sugar | 10 | 10 |
| Sodium laurylsulphate | 15 | 15 |
| Dissolution time in Min. | 8 | 6 |

| Example 4 | |
|---|---|
| Component | Wt. % |
| PVOH | 5 |
| Starch | 3 |
| Ethanol:Water (30:70) | ad 100 |
| Sugar | 10 |
| Esterquat | 5 |
| Dissolution time in Min. | 20-25 |

| Example 5 | |
|---|---|
| Component | Wt. % |
| PVOH | 5 |
| Starch | 3 |
| Ethanol:Water (30:70) | ad 100 |
| Sugar | 10 |
| Capsules (Sym Cap) | 1 |
| Calcium silicate | 1 |
| Perfume oil | 5 |
| Dissolution time in Min. | 14 |

The invention claimed is:

1. An active substance wafer comprising:

(a) 2.0 to 20.0 wt. % of a water-soluble polyvinyl alcohol, (b) 1.0 to 40.0 wt. % of an active substance selected from a fragrance, a cleaning-active and/or protecting substance, a functional agent, and a combination thereof, (c) 0 to 5.0 wt. % of starch, and (d) an additive present in an amount up to 10.0 wt. % selected from a filler, a disintegrant, a binder, and absorber, an antimicrobial, a dye, and a combination thereof, wherein the active substance wafer is not in the form of globules or beads but is a solid having a planar structure that can be cut or split into a desired form;

the active substance wafer is not an extrusion product; and the weight percentages are based on the total weight of the active substance wafer.

2. The active substance wafer according to claim 1 comprising 3 to 12 wt. % of the water-soluble polyvinyl alcohol.

3. The active substance wafer according to claim 1 comprising 5 to 15 wt. % of the active substance of (b).

4. The active substance wafer according to claim 1 comprising:

(a) 5 to 10 wt. % of the water-soluble polyvinyl alcohol, (b) 7 to 15 wt. % of the active substance, wherein the active substance is a fragrance, (c) 2 to 5 wt. % of the starch, and (d) 1 to 8 wt. % of the additive.

5. The active substance wafer according to claim 1, wherein the water-soluble polyvinyl alcohol has an average degree of hydrolysis of 65 to 99.99 Mol %.

6. A method for producing the active substance wafer according to claim 1 comprising:

providing a substrate material, applying a layer of a mixture to the substrate material, wherein the mixture comprises:

(i) a water-soluble polyvinyl alcohol, (ii) an active substance selected from a fragrance, a cleaning-active and/or protecting substance, a functional agent, and a combination thereof, (iii) starch, and (iv) an additive selected from a filler, a disintegrant, a binder, and absorber, an antimicrobial, a dye, and a combination thereof, drying the layer of the mixture applied to the substrate material, and detaching the dried layer of the mixture from the substrate material to obtain the active substance wafer.

7. The method according to claim 6, wherein the mixture comprises a solvent, wherein the water-soluble polyvinyl alcohol is dissolved in the solvent.

8. The method according to claim 7, wherein the solvent is an ethanol-water-mixture.

9. The method according to claim 6, wherein a subsequent layer of the mixture is applied to the dried layer of the mixture and allowed to dry to the dried layer of the mixture.

10. The method according to claim 6, wherein the substrate material comprises a metal, plastic, glass, or a combination thereof.

11. The active substance wafer according to claim 1, wherein the active substance of (b) is in an encapsulated form.

12. The active substance wafer according to claim 5, wherein the water-soluble polyvinyl alcohol has an average degree of hydrolysis of 75 to 95 Mol %.

13. The method according to claim 7, wherein the solvent comprises 30 to 70 wt. % of water and 30 to 70 wt. % of ethanol, based on the total weight of the solvent.

14. The method of claim 10, wherein the substrate is coated with melanin.

15. A product comprising the active substance wafer of claim 1, wherein the product is in the form of a laundry care agent, a hand laundry washing agent, or a dishwashing agent.

16. The active substance wafer of claim 1 being free from starch.

17. The active substance wafer of claim 1 being free from anionic surfactants.

18. The active substance wafer of claim 1, wherein the active substance wafer dissolves in water at a temperature of 24° C. with stirring at 270 rpm.

19. The active substance wafer of claim 1, wherein the additive comprises a filler selected from sugar, a silicate, or a combination thereof.

20. An active substance wafer produced by:

providing a substrate material, applying a layer of a mixture to the substrate material, wherein the mixture comprises:

(i) a water-soluble polyvinyl alcohol, (ii) an active substance selected from a fragrance, a cleaning-active and/or protecting substance, a functional agent, and a combination thereof, (iii) starch, and (iv) an additive selected from a filler, a disintegrant, a binder, and absorber, an antimicrobial, a dye, and a combination thereof, drying the layer of the mixture applied to the substrate material, and detaching the dried layer of the mixture from the substrate material to obtain the active substance wafer, wherein the active substance wafer comprises:

(a) 2.0 to 20.0 wt. % of a water-soluble polyvinyl alcohol, (b) 1.0 to 40.0 wt. % of an active substance selected from a fragrance, a cleaning-active and/or protecting substance, a functional agent, and a combination thereof, (c) 0 to 5.0 wt. % of starch, and (d) greater than 0 to 10.0 wt. % of an additive selected from a filler, a disintegrant, a binder, and absorber, an antimicrobial, a dye, and a combination thereof, wherein weight percentages are based on the total weight of the active substance wafer, and the active substance wafer is not in the form of globules or beads but is a solid having a planar structure that can be cut or split into a desired form, and the active substance wafer is not an extrusion product.

* * * * *